US010060214B2

(12) United States Patent
Hradecky

(10) Patent No.: US 10,060,214 B2
(45) Date of Patent: Aug. 28, 2018

(54) DOWNHOLE ROLLER

(71) Applicant: Impact Selector International, LLC, Houma, LA (US)

(72) Inventor: Jason Allen Hradecky, The Woodlands, TX (US)

(73) Assignee: Impact Selector International, LLC, Houma, LA (US)

( * ) Notice: Subject to any disclaimer, the term of this patent is extended or adjusted under 35 U.S.C. 154(b) by 644 days.

(21) Appl. No.: 14/618,243

(22) Filed: Feb. 10, 2015

(65) Prior Publication Data

US 2015/0226037 A1 Aug. 13, 2015

Related U.S. Application Data

(60) Provisional application No. 61/938,801, filed on Feb. 12, 2014.

(51) Int. Cl.
*E21B 23/14* (2006.01)
*E21B 17/14* (2006.01)

(52) U.S. Cl.
CPC ..... *E21B 23/14* (2013.01); *E21B 17/14* (2013.01)

(58) Field of Classification Search
CPC ..... E21B 17/14; E21B 23/14; E21B 2023/008
See application file for complete search history.

(56) References Cited

U.S. PATENT DOCUMENTS

| | | | | |
|---|---|---|---|---|
| 1,733,336 | A | 10/1929 | De Costa | |
| 4,415,030 | A | 11/1983 | Walkow et al. | |
| 7,434,627 | B2 | 10/2008 | Turley et al. | |
| 8,011,429 | B2 | 9/2011 | McNay | |
| 2006/0070733 | A1 | 4/2006 | Al-Zharani | |
| 2012/0061098 | A1 | 3/2012 | Hall | |
| 2012/0145380 | A1 | 6/2012 | Draper et al. | |
| 2013/0248208 | A1 | 9/2013 | Copold et al. | |
| 2014/0367169 | A1* | 12/2014 | Wheater | E21B 23/14 175/45 |

FOREIGN PATENT DOCUMENTS

| | | | |
|---|---|---|---|
| GB | 2429483 | A | 2/2007 |
| SU | 1263809 | A1 | 8/1984 |
| WO | 20100106312 | A2 | 9/2010 |

* cited by examiner

*Primary Examiner* — Brad Harcourt
(74) *Attorney, Agent, or Firm* — Boisbrun Hofman, PLLC

(57) ABSTRACT

An apparatus comprising a housing to be coupled to an end of a downhole tool, a member rotatably coupled to the housing, and first and second arms extending from the member. A first wheel is rotatably coupled between the first and second arms, a second wheel is rotatably coupled with the first arm opposite the first wheel, and a third wheel is rotatably coupled with the second arm opposite the first wheel. The first, second, and third wheels independently rotate relative to the first and second arms, and collectively rotate with the member relative to the housing.

26 Claims, 8 Drawing Sheets

DOWNHOLE ROLLER

CROSS-REFERENCE TO RELATED APPLICATIONS

This application claims priority to and the benefit of U.S. Provisional Application No. 61/938,801, entitled "Open-Hole Bullnose Roller," filed Feb. 12, 2014, the entire disclosure of which is hereby incorporated herein by reference.

BACKGROUND OF THE DISCLOSURE

In the oil and gas industry, hydrocarbon reservoirs have conventionally been accessed by vertical or near-vertical wellbores. Such reservoirs, however, are increasingly accessed via non-vertical wellbores.

Tools that have conventionally been used in the vertical or near-vertical wellbores may encounter problems when used in the non-vertical wellbores. Such tools may be lowered into wellbores as part of a tool string utilizing gravity to facilitate transport or movement therethrough. In non-vertical wellbores, gravity may be negated by frictional forces between the tool string and walls of the wellbore, thus resisting movement of the tool string through the wellbore. Furthermore, particularly with open-hole wellbores not lined with casing, outer surfaces of the tool string may stick to the wall of the wellbore, or edges of the tool string may dig into or jam against imperfections in the wall of the wellbore.

In addition to the increased friction due to an increased horizontal gradient, the movement of the tool string along the non-vertical wellbores may be impeded further by the presence of various obstacles. For example, washouts, sharp bends, misaligned tubular joins, transitions between lining, casing, and bare walls of the wellbore, and other uneven surfaces may present an increased resistance or impediments to the movement of the tool string through the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
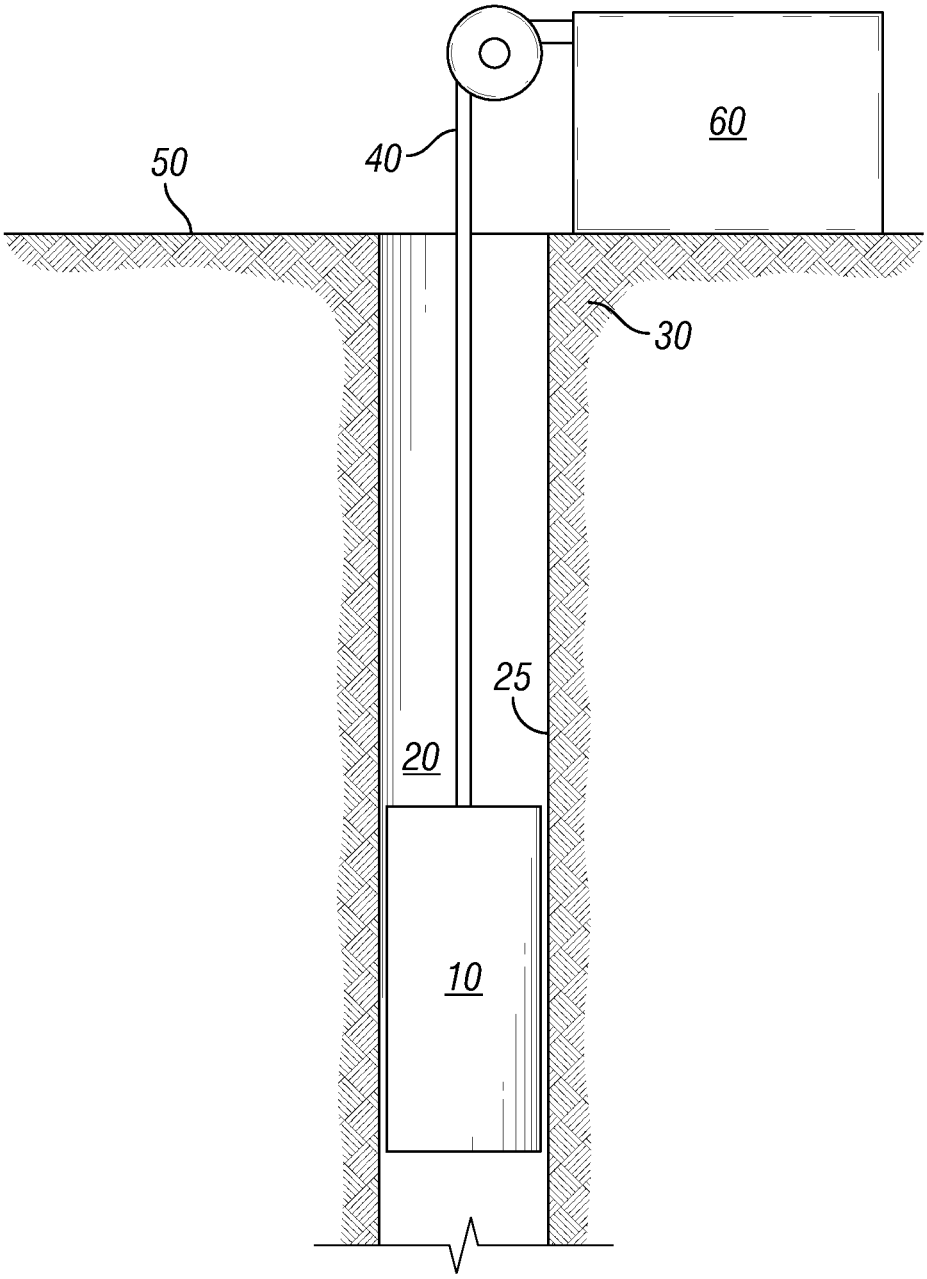
FIG. 1 (Prior Art)
FIG. 1 is a schematic view of prior art apparatus disposed in a substantially vertical wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of a downhole conveyance system often used in the oil and gas industry utilized in a substantially vertical wellbore. The figure depicts a downhole tool string 10 suspended in a wellbore 20 that extends through one or more subterranean formations 30. The downhole tool string 10 may be suspended via a wireline, slickline, e-line, cable, and/or other conveyance means 40, such as may be spooled at a wellsite surface 50 and coupled to surface equipment 60. Although depicted as a single element, the tool string 10 may comprise multiple downhole tools and/or pieces of equipment. The wellbore 20 is shown substantially vertical, or perpendicular to the wellsite surface 50. The conveyance means 40 may be reeled in and out such that gravity and the unreeled length of the conveyance means 40 primarily dictate the depth of the downhole tool string 10. In a substantially vertical wellbore, such as the wellbore 20 shown in FIG. 1, the sidewalls 25 of the wellbore 20 may not substantially impede the intended conveyance or movement of the downhole tool string 10 within the wellbore 20. However, this may not be true for non-vertical wellbores.

Figure 2:
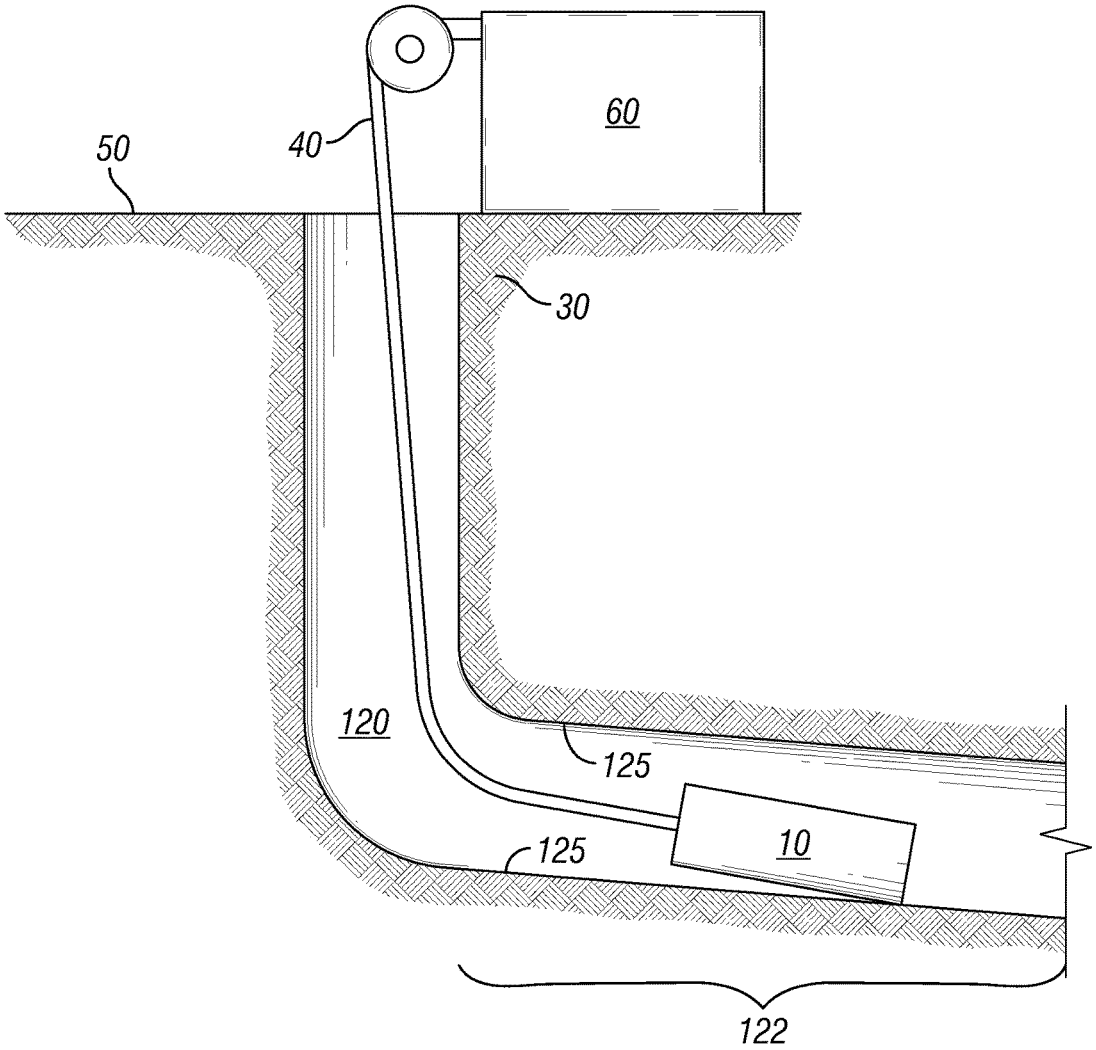
FIG. 2 (Prior Art)
FIG. 2 is a schematic view of the prior art apparatus shown in FIG. 1 disposed in a substantially non-vertical wellbore.

Wells being drilled today are increasingly likely to have at least one section that is not substantially vertical. FIG. 2 is a schematic view of the downhole conveyance system of FIG. 1, showing the downhole tool string 10 suspended in a non-vertical section 122 of the wellbore 120. As a result, sidewalls 125 of the non-vertical section 122 of the wellbore 120 may cause friction against the downhole tool string 10 and/or otherwise impede the intended conveyance or movement of the downhole tool string 10 through the wellbore 120. Moreover, impacts, friction, vibrations, and other forces resulting from such impediment may cause damage to the downhole tool string 10 when conveyed through the substantially non-vertical section 122 of the wellbore 120.

Figure 3:
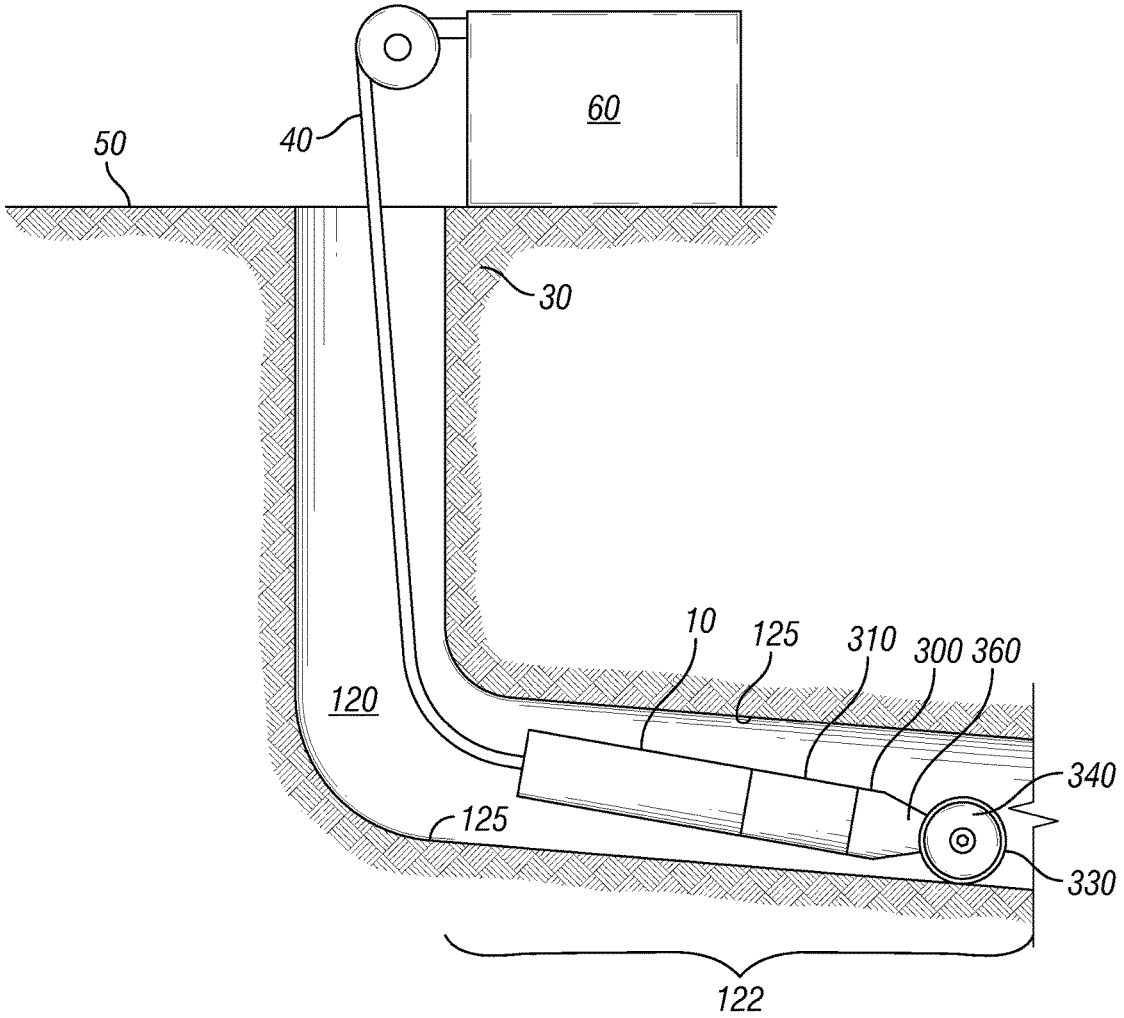
FIG. 3 is a schematic view of at least a portion of apparatus according to one or more aspects of the present disclosure.

Accordingly, the present disclosure introduces a roller apparatus 300 that may aid in conveying or otherwise moving the downhole tool string 10 along a non-vertical section of a wellbore, such as the non-vertical section 122 of the wellbore 120. FIG. 3 depicts a schematic view of the downhole conveyance system of FIG. 2, but also comprising the roller apparatus 300 according to one or more aspects of the present disclosure. The roller apparatus 300 may be coupled directly to the downhole tool string 10, and may include a housing 310, wheels 330, 340, 350 (350 hidden from view), and arms 360, 365 (365 hidden from view) extending between the wheels 330, 340, 350 and the housing 310. During conveyance operations, the roller apparatus 300 may lift or support at least a portion of the tool string 10 at a distance from the sidewall 125 of the wellbore 120, such as may eliminate or reduce contact and/or friction between the tool string 10 and the sidewall 125. For example, the roller apparatus 300 may be supported at a distance from the sidewall 125 of the wellbore 120 by the wheels 330, 340, 350, which may permit the roller apparatus 300 and, therefore, the downhole tool string 10 to roll along the sidewalls 125 of the wellbore 120 along a longitudinal axis of the wellbore 120.

Figure 4:
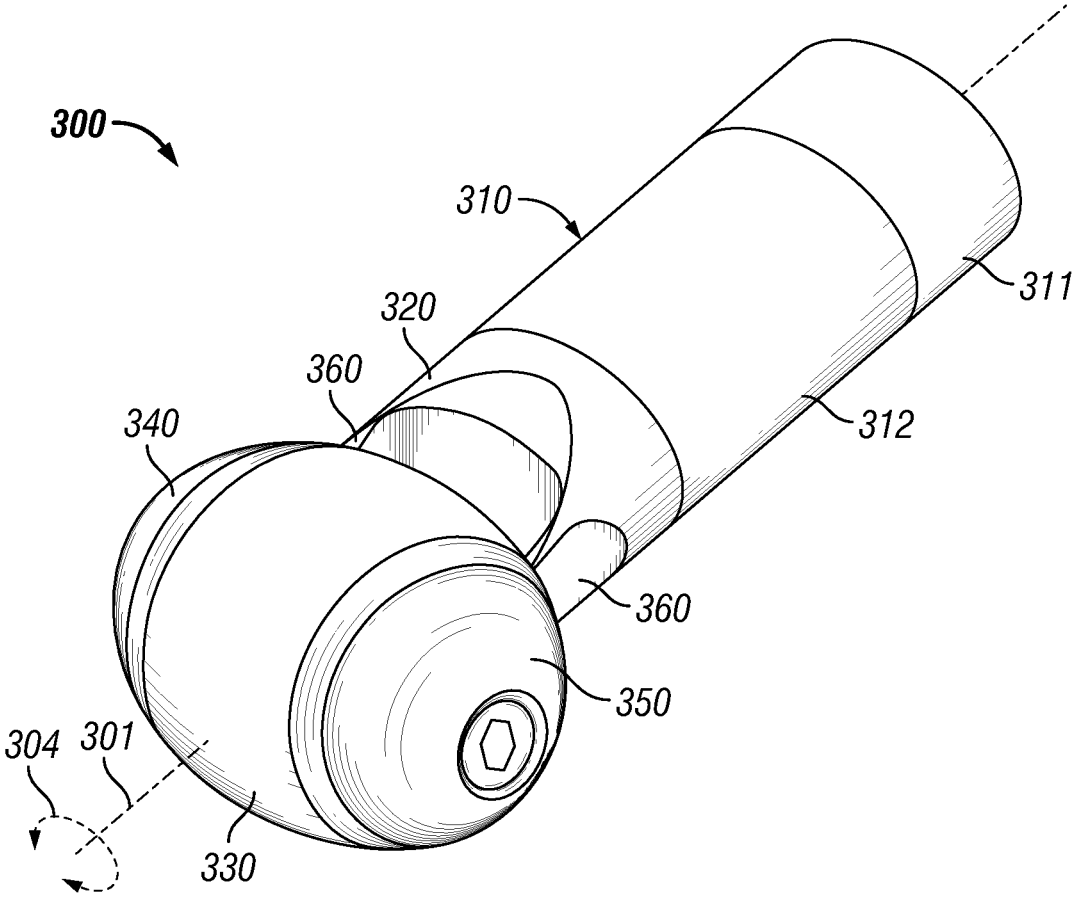
FIG. 4 is a perspective view of a portion of an example implementation of the apparatus shown in FIG. 3 according to one or more aspects of the present disclosure.
Figure 5:
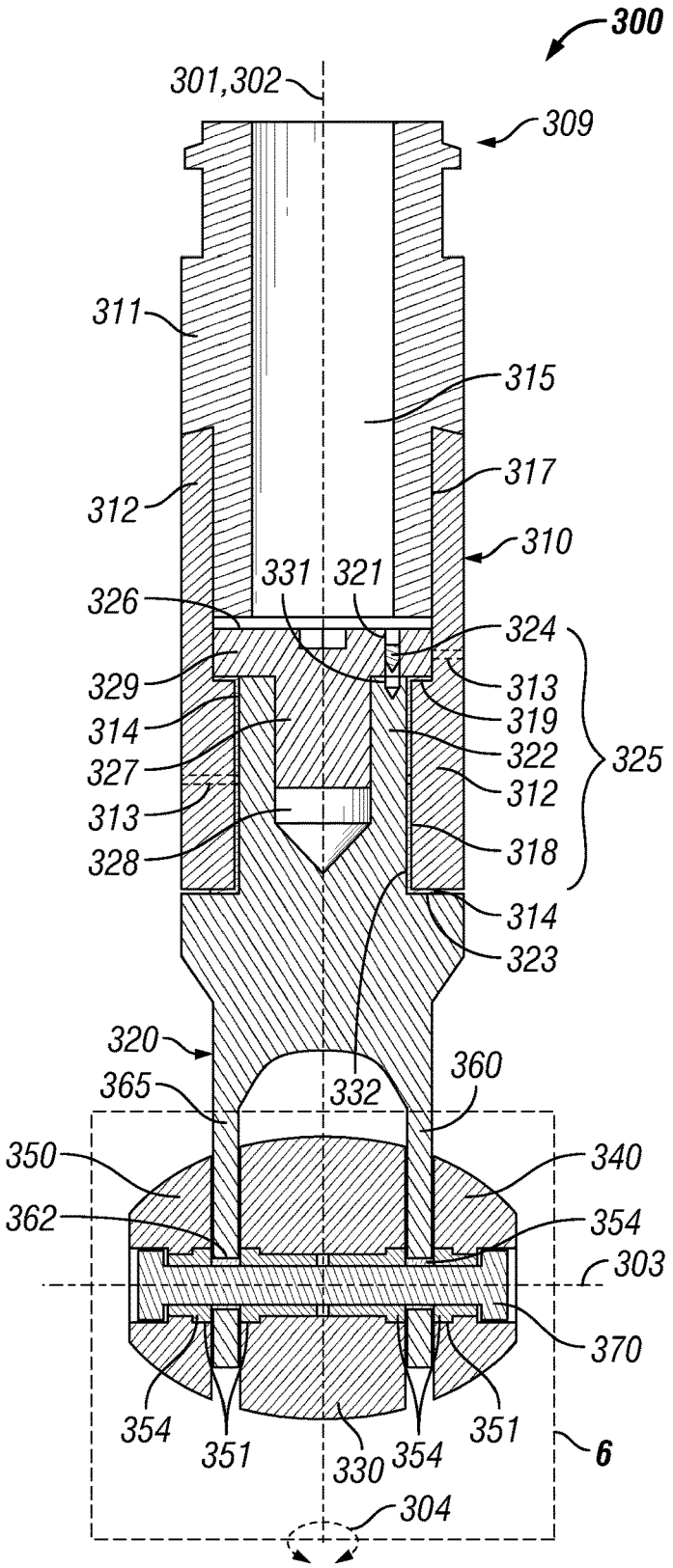
FIG. 5 is a sectional view of a portion of an example implementation of the apparatus shown in FIG. 3 according to one or more aspects of the present disclosure.

FIGS. 4 and 5 are a perspective and sectional views, respectively, of at least a portion of an example implementation of the roller apparatus 300 shown in FIG. 3 according to one or more aspects of the present disclosure. Referring to FIGS. 3-5, collectively, the roller apparatus 300 is shown comprising the housing 310, the wheels 330, 340, 350, and a swiveling member 320 rotatably coupling the wheels 330, 340, 350 with the housing 310.

The housing 310 may be or comprise a generally tubular member having a bore 315 extending longitudinally at least partially therethrough. The housing 310 may be operable to couple with an end of the downhole tool string 10 or another downhole tool that may be lowered into the wellbore 120. The housing 310 may comprise a tool connector portion 311, which may comprise means for attachment to the downhole tool string 10. For example, the tool connector portion 311 may comprise a male coupler end 309, which may be inserted into and mate with a corresponding female coupler end (not shown) of the downhole tool string 10. In other implementations, the tool connector portion 311 may comprise one or more threaded fasteners (not shown) or threaded portions (not shown), which may engage a corresponding one or more threaded fasteners (not shown) or threaded portions (not shown) of the downhole tool string 10. However, other means for attaching the housing 310 with the downhole tool string 10 are also within the scope of the present disclosure. Although the tool connector portion 311 is shown as a generally tubular member having the bore 315 extending therethrough, the tool connector portion 311 may not be generally tubular, and may be a solid member (not shown) not including the bore 315.

The housing 310 may further comprise a receiving portion 312 fixedly coupled with the tool connector portion 311. The receiving portion 312 may have a generally tubular configuration, perhaps comprising a portion of the bore 315 that is defined by a wider inner surface (e.g., larger inner diameter) 317 and a narrower inner surface (e.g., smaller inner diameter) 318. The receiving portion 312 may further comprise a shoulder 319, such as may form a transition between the wider inner surface 317 and the narrower inner surface 318. The shoulder 319 may protrude radially inward from the wider inner surface 317 and extend circumferentially between the wider and the narrower inner surfaces 317, 318 of the receiving portion 312. The wider inner surface 317 may comprise an internal thread (not shown) engaging a corresponding external thread (not shown) of the tool connector portion 311, while the receiving portion 312 defined by the narrower inner surface 318 may contain therein a portion of the swiveling member 320, as described below. Although the housing 310 is shown comprising distinct and/or separable receiving and tool connector portions 312, 311, the housing 310 may comprise a single, integrally formed housing 310, or the housing 310 may comprise additional distinct housing portions (not shown), such as one or more intermediate housing portions connected between the receiving portion 312 and the tool connector portion 311.

As shown in FIG. 5, the swiveling member 320 may comprise the arms 360, 365, a shoulder 323, a cylindrical portion 322, and a retainer 326. The swiveling member 320 may comprise a generally elongate configuration, with two substantially parallel arms 360, 365 extending in the downhole direction on opposite sides a central axis 301 of the roller apparatus 300. The arms 360, 365 may comprise elongate members separated by a predetermined distance that may permit disposition of a first wheel 330 therebetween, and may extend a distance along a direction substantially parallel to the central axis 301 that may permit installation of wheels 330, 340, 350 having different diameters. Each arm 360, 365 may further comprise an aperture 362 extending therethrough adjacent or proximate its downhole end. The arms 360, 365 may be connected with the cylindrical portion 322, which may extend in the uphole direction along the central axis 301 of the roller apparatus 300.

The cylindrical portion 322 of the swiveling member 320 may be disposed within the receiving portion 312 of the housing 310 to form a swivel device 325, which may permit the swiveling member 320 to swivel or rotate about a first axis of rotation 302 relative to the housing 310 and, thus, the downhole tool string 10 connected with the housing 310, as depicted by arrow 304. In FIG. 5, the cylindrical portion 322 and the receiving portion 312 are shown centrally disposed along the central axis 301 of the roller apparatus 300, such that the central axis 301 of the roller apparatus 300 and the first axis of rotation 302 of the swiveling member 320 may substantially coincide. However, other implementations (not shown) of the roller apparatus 300 may comprise the central axis 301 and the first axis or rotation 302 extending substantially parallel and/or at a distance from each other.

The retainer 326 may fixedly connect with the cylindrical portion 322 to maintain the swiveling member 320 in connection with the housing 310. For example, the swiveling member 320 may further comprise a threaded cavity 328 extending along the central axis 301 through at least a portion of the cylindrical portion 322. The retainer 326 may comprise a head 329 and a threaded portion 327 having external threads (not shown) operable to engage corresponding internal threads (not shown) of the threaded cavity 328. When the threaded portion 327 is substantially engaged within the threaded cavity 328, the head 329 may contact or come into close proximity with the shoulder 319 of the receiving portion 312, such as may prevent the cylindrical portion 322 and, therefore, the swiveling member 320 from retracting from within the receiving portion 312, or from otherwise moving in the downhole direction relative to the housing 310. Furthermore, when the threaded portion 327 is substantially engaged within the threaded cavity 328, the retainer 326 may be encapsulated or disposed entirely within the housing 310.

The shoulder 323 may protrude radially outward with respect to the central axis 301, and may extend circumferentially about a substantially portion of the circumference of the swiveling member 320 at an axial position between the arms 360, 365 and the cylindrical portion 322. Thus, when the threaded portion 327 is substantially engaged within the threaded cavity 328, the shoulder 323 of the swiveling member 320 may contact or come into close proximity with the downhole end of the receiving portion 312, such as may aid in preventing the swiveling member 320 from moving in the uphole direction relative to the housing 310.

The retainer 326 may be secured in the engaged position with a fastener 324 extending through at least portions of each of the retainer 326 and the cylindrical portion 322. For example, the fastener 324 may be or comprise a threaded bolt, which may be translated or otherwise moved through a threaded hole 321 extending through the head 329 into a corresponding threaded aperture or other cavity 331 in the cylindrical portion 322. When disposed within both the threaded hole 321 of the head 329 and the cavity 331 of the cylindrical portion 322, the fastener 324 may function as a latch, which may prevent relative rotation between the retainer 326 and the cylindrical portion 322. The fastener 324 may be maintained in the installed position by thread-locking adhesive and/or other means.

Although FIG. 5 depicts the cylindrical portion 322 as being part of the swiveling member 320 and the receiving portion 312 as being part of the housing 310, other implementations of the swivel device 325 are also within the scope of the present disclosure. For example, the swivel device 325 may comprise the cylindrical portion 322 as part of the housing 310 or fixedly connected with the housing 310 and the receiving portion 312 as part of the swiveling member 320 or fixedly connected with the swiveling member 320. Furthermore, although FIG. 5 depicts the cylindrical portion 322, the shoulder 323, and the arms 360, 365 being integrally formed as the swiveling member 320, the swiveling member 320 may comprise a plurality of discrete or intermediate portions (not shown) coupled together to form the swiveling member 320. For example, the swiveling member 320 may comprise a discrete cylindrical portion, shoulder, and arms (not shown), which are fixedly coupled together.

The cylindrical portion 322 of the swiveling member 320 and, therefore, the shoulder 323, the arms 360, 365, and the wheels 330, 340, 350 may be disconnected from the housing 310, such as during disassembly, maintenance, or when replacing components. For example, to detach the cylindrical portion 322 from the retainer 326, the fastener 324 may be removed, and the retainer 326 and/or the cylindrical portion 322 may then be rotated relative to each other until the retainer 326 and the cylindrical portion 322 disengage. Thereafter, the cylindrical portion 322 may be removed from within the receiving portion 312 and, therefore, disconnected from the housing 310, along with the shoulder 323, the arms 360, 365, and the wheels 330, 340, 350.

The cylindrical portion 322 may further comprise an outer surface 332, which, along with the narrower inner surface 318 of the receiving portion 312, may comprise a finish that may be sufficiently smooth and/or otherwise facilitate low friction between the surfaces when the swiveling member 320 rotates within the housing 310. The annular space between the outer surface 332 and the narrower inner surface 318 may also comprise one or more bearings 314, which may aid in reducing friction and/or assisting rotation of the swiveling member 320 relative to the housing 310. For example, as shown in FIG. 5, the bearings 314 may be or comprise one or more sleeves or bushings disposed between the outer surface 332 and the narrower inner surface 318. The bearings 314 may also be disposed between the shoulder 323 of the swiveling member 320 and the receiving portion 312, as well as between the shoulder 319 of the receiving portion 312 and the head 329 of the retainer 326. The bearings 314 may be supplied with grease or lubricant through one or more fill/bleed ports 313 extending between the annular space comprising the bearings 314 and outer surface of the housing 310.

The bearings 314 may comprise different materials relative to the steel material used to form the swiveling member 320 and the housing 310, such as may comprise another (perhaps hardened) steel, cast iron, bronze, brass, ceramic material, graphite, nylon, polyacetal, polytetrafluoroethylene (PTFE), ultra-high-molecular-weight polyethylene (UHMWPE), RULON, polyether-ether-ketone (PEEK), urethane, VESPEL, and/or other polymers, among other examples within the scope of the present disclosure. Although the bearings 314 are depicted in FIG. 5 as sleeves or bushings, the bearings 314 may comprise mechanical bearings (not shown), such as ball bearings, roller bearings, or thrust bearings. The bearings 314 may also comprise plain bearings (not shown), wherein the outer surface 332 of the cylindrical portion 322 and the narrower inner surface 318 of the receiving portion of 312 are in direct metal-to-metal contact and/or have a layer of lubricant therebetween.

Figure 6:
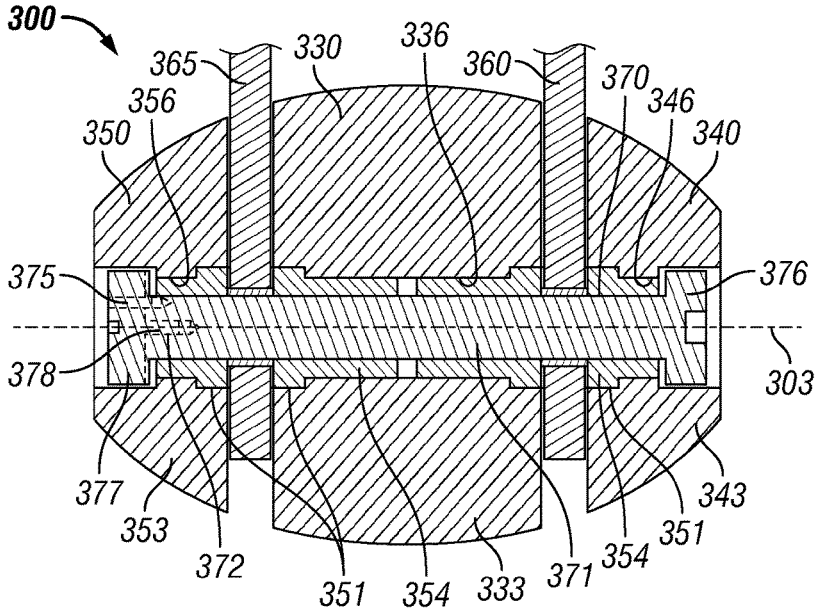
FIG. 6 is an enlarged view of a portion of the apparatus shown in FIG. 5 according to one or more aspects of the present disclosure.

FIG. 6 is an enlarged view of a portion of the roller apparatus 300 shown in FIG. 5 according to one or more aspects of the present disclosure. Referring to FIGS. 5 and 6, collectively, the roller apparatus 300 may further comprise a shaft 370 operable to couple the wheels 330, 340, 350 to the arms 360, 365. The shaft 370 may extend through the arms 360, 365, the first (i.e., central) wheel 330, and at least a portion of each of second and third (i.e., outer) wheels 340, 350, facilitating rotation of the wheels 330, 340, 350 about the shaft 370, and thus rotatably coupling the wheels 330, 340, 350 with the arms 360, 365. The shaft 370 may have a generally cylindrical and elongated configuration comprising a head or retainer 376, 377 at one or both ends thereof.

The retainers 376, 377 may be integrally connected with a body portion 371 of the shaft 370 (such as the first retainer 376 in the example implementation shown in FIG. 6), or the retainers 376, 377 may be discrete members connectable with the body portion 371 (such as the second retainer 377 in the example implementation shown in FIG. 6). Where either retainer 376, 377 is a discrete member connectable with the body portion 371, the retainer 376, 377 may comprise a threaded portion 378, such as may be operable to engage a corresponding threaded cavity 372 extending into the body portion 371, thereby coupling the retainer 376, 377 with the body portion 371. The shaft 370 may further comprise one or more threaded fasteners 375 extending through both the discrete retainer 376, 377 and into the body portion 371, such as to further secure the discrete retainer 376, 377 with the body portion 371 and/or to prevent relative rotation between the discrete retainer 376, 377 and the body portion 371.

Whether discrete or integral to the body portion 371, the retainers 376, 377 may be operable to retain the wheels 330, 340, 350 and/or a plurality of bearings 354 disposed about the shaft 370. Since at least one of the retainers 376, 377 may be detachable from the body portion 371, the shaft 370 may be removed from within the wheels 330, 340, 350, thus permitting the wheels 330, 340, 350 to be detached from the arms 360, 365 and replaced with other wheels, which may have different sizes. For example, one or more of the wheels 330, 340, 350 may be replaced without also replacing the swiveling member 320 (e.g., of another size).

The bearings 354 may be disposed in corresponding annular spaces between the shaft 370 and inner surfaces 336, 346, 356 of the wheels 330, 340, 350, such as to aid in improving rotation and/or decrease friction between the shaft 370 and the wheels 330, 340, 350. For example, the bearings 354 may each be or comprise one or more sleeves or bushings disposed between the shaft 370 and the corresponding wheel 330, 340, 350. The bearings 354 may also be disposed between the retainers 376, 377 and the second and third wheels 340, 350, as well as between the arms 360, 365 and the first, second, and third wheels 330, 340, 350. The inner surfaces 336, 346, 356 may comprise one or more circumferential grooves or countersunk portions 351, which may be operable to assist in securing the bearings 354 in a predetermined position relative to the wheels 330, 340, 350.

The bearings 354 may comprise different materials relative to the steel material used to form the shaft 370 and the wheels 330, 340, 350, such as may comprise another (perhaps hardened) steel, cast iron, bronze, brass, ceramic material, graphite, nylon, polyacetal, PTFE, UHMWPE, RULON, PEEK, urethane, VESPEL, and/or other polymers, among other examples within the scope of the present disclosure. Although the bearings 354 are depicted in FIG. 6 as sleeves or bushings, the bearings 354 may comprise mechanical bearings (not shown), such as ball bearings, roller bearings, or thrust bearings. The bearings 354 may also comprise plain bearings (not shown), wherein the wheels 330, 340, 350 and the shaft 370 are in direct contact and/or have a layer of lubricant therebetween.

FIGS. 5 and 6 further show the first wheel 330 rotatably coupled between the first and second arms 360, 365, the second wheel 340 rotatably coupled with the first arm 360 opposite the first wheel 330, and the third wheel 350 rotatably coupled with the second arm 365 opposite the first wheel 330, wherein the first, second, and third wheels 330, 340, 350 may independently rotate relative to each other and/or the first and second arms 360, 365. The wheels 330, 340, 350 may rotate about a second axis of rotation 303, which may extend substantially perpendicular with respect to the central axis 301 of the roller apparatus 300 and/or the first axis of rotation 302.

Figure 7:
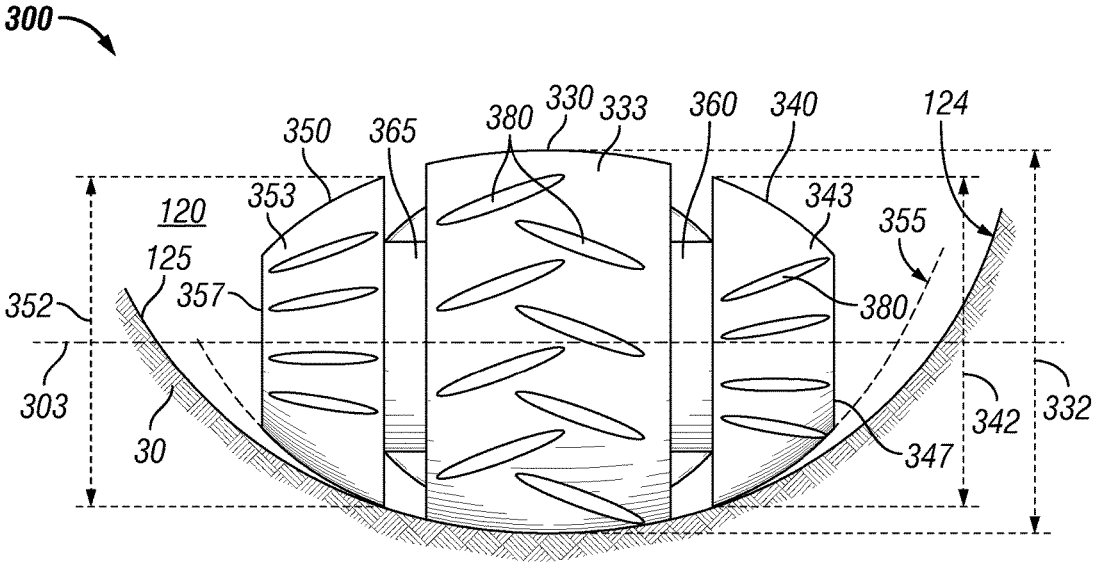
FIG. 7 is a bottom view of a portion of an example implementation of the apparatus shown in FIG. 3 according to one or more aspects of the present disclosure.

FIG. 7 is a bottom view of a portion of the roller apparatus 300 and the wellbore 120 shown in FIG. 3 according to one or more aspects of the present disclosure. Referring to FIGS. 6 and 7, collectively, the wheels 330, 340, 350 may comprise curved or convex outer surfaces 333, 343, 353, such that, collectively, the wheels 330, 340, 350 may form a substantially spherical or spheroidal shape. Thus, the outermost diameter 332 of the first wheel 330 may be substantially greater than the outermost diameters 342, 352 of the second and third wheels 340, 350. The second and third wheels 340, 350 may comprise a bowl-shaped configuration with an outer end 347, 357 of each wheel 340, 350 being substantially planar or truncated along the second axis of rotation 303. The outer surfaces 333, 343, 353 may comprise one or more grooves 380, which may form a spiral pattern, or alternating pattern, although other distributions of the one or more grooves 380 are also within the scope of the present disclosure.

The collective spherical or spheroidal shape of the wheels 330, 340, 350 may increase the contact area between the sidewall 125 of the wellbore 120 while minimizing the weight and outermost diameters 332, 342, 352 of the wheels 330, 340, 350. The collective spherical or spheroidal shape of the wheels 330, 340, 350 may also promote rotation of the wheels 330, 340, 350 and the swiveling member 320 about the first axis of rotation 302 to a righted orientation, shown in FIGS. 7 and 8. For example, the profile of the three wheels 330, 340, 350 may comprise a collective diameter 355 that varies from the cross-sectional diameter 124 of at least a portion of the wellbore 120 by less than about ten percent.

Figure 8:
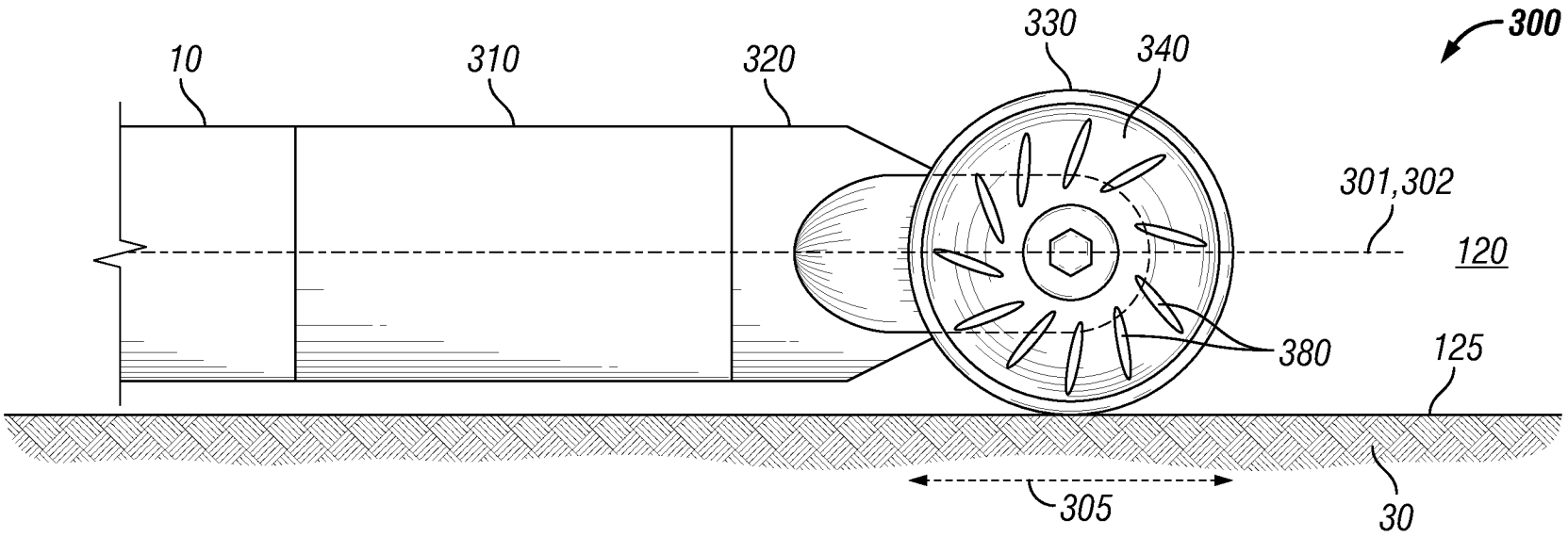
FIG. 8 is a schematic view of a portion of an example implementation of the apparatus shown in FIG. 3 according to one or more aspects of the present disclosure.

FIG. 8 is a schematic side view of a portion of an example implementation of the roller apparatus 300 shown in FIG. 3 according to one or more aspects of the present disclosure. The wheels 330, 340, 350 (350 hidden from view) may be operable to allow bidirectional motion of the swiveling member 320, the housing 310, and the downhole tool 10 along the sidewall 125 of the wellbore 120, as depicted by arrow 305. The central axis 301 of the roller apparatus 300 may be substantially parallel or at an angle with respect to the sidewall 125 of the wellbore 120. Also, because the first, second, and third wheels 330, 340, 350 are independent coupled to the shaft 370, they may independently rotate at different speeds (relative to each other) while rolling along the sidewall 125 of the wellbore 120.

Figure 9:
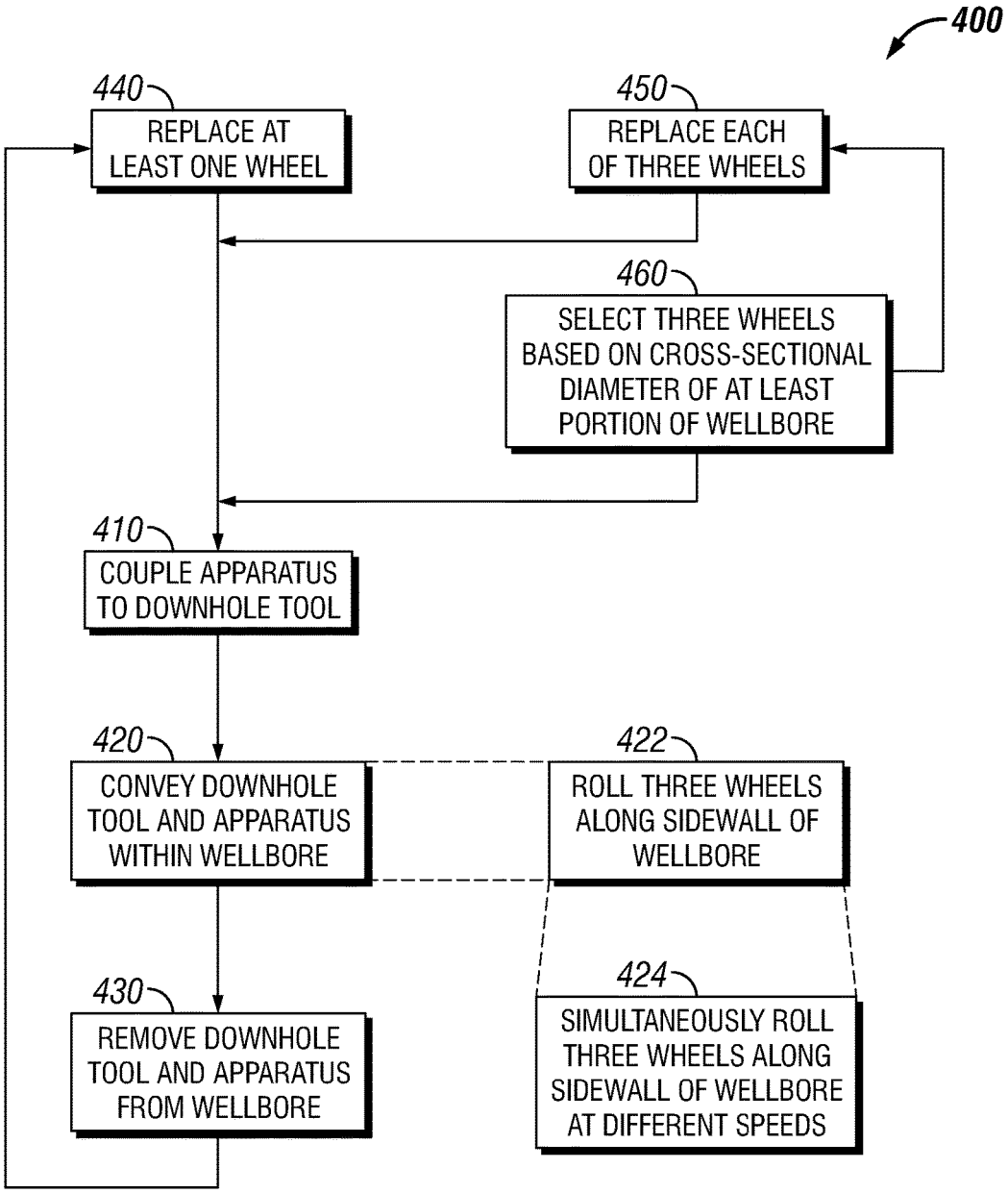
FIG. 9 is a flow-chart diagram of at least a portion of a method according to one or more aspects of the present disclosure.

FIG. 9 is a flow-chart diagram of at least a portion of a method 400 according to one or more aspects of the present disclosure. The method 400 may be performed utilizing one or more embodiments of the apparatus shown in one or more of FIGS. 3-8 or otherwise within the scope of the present disclosure.

The method 400 may comprise coupling 410 an apparatus to an end of a downhole tool. The apparatus may be substantially similar to the roller apparatus 300 shown in one or more of FIGS. 3-8, and the downhole tool may be substantially similar to the downhole tool 10 shown in one or more of FIGS. 1-3 and 8. The apparatus comprises three wheels (such as the wheels 330, 340, 350 shown in one or more of FIGS. 3-8) that are independently rotatable about a first axis (such as axis 303 shown in one or more of FIGS. 5-7) and collectively rotatable about a second axis (such as 302 shown in one or more of FIGS. 5 and 8) that is substantially perpendicular to the first axis. The method 400 further comprises conveying 420 the downhole tool and apparatus within a wellbore extending into a subterranean formation (such as the wellbore 120 and formation 30 shown in one or more of FIGS. 2, 3, 7, and 8). Such conveyance 420 may include rolling 422 the three wheels of the apparatus along a sidewall of the wellbore, such as simultaneously rolling 424 each of the three wheels along the sidewall of the wellbore, perhaps at different rotational speeds. The method 400 may further comprise removing 430 the downhole tool and apparatus from the wellbore.

Whether before initially inserting the apparatus and downhole tool into the wellbore, the method 400 may also comprise replacing 440 at least one of the three wheels with another wheel or replacing 450 each of the three wheels with three other wheels. For example, the method 400 may further comprise selecting 460 three wheels based on a cross-sectional diameter of at least a portion of the wellbore. Such selection 460 may comprise selecting the three wheels such that a diameter of at least a portion of a collective cross-sectional profile of the selected three wheels varies from the cross-sectional diameter of the at least portion of the wellbore by less than about ten percent.

In view of the entirety of the present disclosure, including the figures, a person having ordinary skill in the art will readily recognize that the present disclosure introduces an apparatus comprising: a housing to be coupled to an end of a downhole tool; a member rotatably coupled to the housing; first and second arms extending from the member; a first wheel rotatably coupled between the first and second arms; a second wheel rotatably coupled with the first arm opposite the first wheel; and a third wheel rotatably coupled with the second arm opposite the first wheel, wherein the first, second, and third wheels independently rotate relative to the first and second arms.

The downhole tool may be to be conveyed within a wellbore extending into a subterranean formation.

The member may rotate relative to the housing about a first axis, which may be substantially parallel with a longitudinal axis of the downhole tool, and the first, second, and third wheels may rotate relative to the first and second arms about a second axis, which may be substantially perpendicular to the longitudinal axis of the downhole tool.

The member and the housing may be rotatably coupled by a cylindrical portion secured within a receiving portion, and a first one of the housing and the member may comprise the cylindrical portion and a second one of the housing and the member may comprise the receiving portion. In such implementations, the member may comprise the cylindrical portion and the housing may comprise the receiving portion. The apparatus may further comprise a retainer coupled with the cylindrical portion within the housing. The retainer may be coupled with the cylindrical portion via threaded engagement. The retainer may extend longitudinally substantially coincident with the second axis within the housing. The retainer may be disposed entirely within the housing. The apparatus may further comprise a locking member extending into the retainer and the cylindrical portion.

The apparatus may further comprise a shaft extending through the first and second arms, the first wheel, and a portion of each of the second and third wheels, wherein the first, second, and third wheels may rotate about the shaft. The shaft may comprise a first portion and a second portion threadedly engaged with the first portion. The shaft may further comprise a locking member extending into the first and second portions. The apparatus may further comprise a bearing disposed between the shaft and at least one of the first, second, and third wheels. The bearing may be selected from the group consisting of: a plain bearing, a ball bearing, a roller bearing, a thrust bearing, a bushing, and a sleeve.

At least one of the first, second, and third wheels may be interchangeable with an alternate wheel having a different size.

At least one of the first, second, and third wheels may be interchangeable with an alternate wheel without decoupling the member and the housing.

The apparatus may further comprise a bearing disposed between the housing and the member. The bearing may be selected from the group consisting of: a plain bearing, a ball bearing, a roller bearing, a thrust bearing, a bushing, and a sleeve.

An outer surface of each of the first, second, and third wheels may comprise a pattern of grooves.

The first wheel may have a first outer diameter and the second and third wheels may each have a second outer diameter that may be substantially smaller than the first outer diameter.

The first, second, and third wheels may collectively form a substantially spherical or spheroidal shape. Opposing ends of the second and third wheels may be substantially planar or truncated along their axis of rotation.

The present disclosure also introduces a method comprising: coupling an apparatus to an end of a downhole tool, wherein the apparatus comprises three wheels independently rotatable about a first axis and collectively rotatable about a second axis substantially perpendicular to the first axis; conveying the downhole tool and apparatus within a wellbore extending into a subterranean formation, including rolling the three wheels along a sidewall of the wellbore; and removing the downhole tool and apparatus from the wellbore.

The method may further comprise replacing one of the three wheels with another wheel prior to conveying the downhole tool and apparatus within the wellbore.

The method may further comprise replacing each of the three wheels with three other wheels prior to conveying the downhole tool and apparatus within the wellbore.

Rolling the three wheels along the sidewall of the wellbore may comprise simultaneously rolling the three wheels along the sidewall of the wellbore.

The method may further comprise selecting the three wheels based on a cross-sectional diameter of at least a portion of the wellbore. Selecting the three wheels based on the cross-sectional diameter of the at least portion of the wellbore may comprise selecting the three wheels such that a diameter of at least a portion of a collective cross-sectional profile of the selected three wheels varies from the cross-sectional diameter of the at least portion of the wellbore by less than about ten percent.

The present disclosure also introduces an apparatus comprising: a housing operable for connection with a downhole tool; and three wheels carried with the housing, wherein the wheels are independently rotatable about a first axis and collectively rotatable about a second axis substantially perpendicular to the first axis.

The three wheels may comprise a central wheel and two outer wheels disposed on opposite sides of the central wheel.

The central wheel may have a first outermost diameter, the outer wheels may each have a second outermost diameter, and the first outermost diameter may be substantially larger than the second outermost diameter.

The apparatus may further comprise a plurality of arms each interposing a corresponding two of the three wheels.

The apparatus may further comprise: a plurality of arms extending between the housing and the three wheels; and at least one shaft extending through each of the plurality of arms, a first one of the wheels, and at least a portion of each of a second one and a third one of the wheels, wherein the first axis may be a longitudinal axis of the at least one shaft. The plurality of arms may comprise: a first arm coupled to the at least one shaft between the first and second ones of the wheels; and a second arm coupled to the at least one shaft between the first and third ones of the wheels.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus, comprising:

a housing to be coupled to an end of a downhole tool;

a member rotatably coupled to the housing;

first and second arms extending from the member;

a first wheel rotatably coupled between the first and second arms;

a second wheel rotatably coupled with the first arm opposite the first wheel; and a third wheel rotatably coupled with the second arm opposite the first wheel, wherein the first, second, and third wheels independently rotate relative to the first and second arms, wherein the first, second, and third wheels each comprise an inner surface defining a corresponding axial bore, and wherein the first, second, and third wheels each comprise at least one radial shoulder extending circumferentially along each inner surface.

2. The apparatus of claim 1 wherein the member rotates relative to the housing about a first axis parallel with a longitudinal axis of the downhole tool, and wherein the first, second, and third wheels rotate relative to the first and second arms about a second axis perpendicular to the longitudinal axis of the downhole tool.

3. The apparatus of claim 1 wherein the member and the housing are rotatably coupled by a cylindrical portion secured within a receiving portion, wherein the cylindrical portion comprises a smooth outer surface and the receiving portion comprises a smooth inner surface, and wherein a first one of the housing and the member comprises the cylindrical portion and a second one of the housing and the member comprises the receiving portion.

4. The apparatus of claim 3 wherein the member comprises the cylindrical portion and the housing comprises the receiving portion.

5. The apparatus of claim 4 further comprising a retainer detachably coupled with the cylindrical portion at an axial end of the cylindrical portion, wherein a diameter of the retainer is larger than a diameter of the cylindrical portion, and wherein the retainer is wholly disposed within the housing.

6. The apparatus of claim 5 further comprising a locking member disposed wholly within the housing and extending into the retainer and the cylindrical portion.

7. The apparatus of claim 3 further comprising a friction reducing bearing disposed between the inner surface of the housing and the outer surface of the member.

8. The apparatus of claim 1 further comprising a shaft extending through the first and second arms, the axial bore of the first wheel, and at least a portion of each of the axial bores of the second and third wheels, wherein the first, second, and third wheels rotate about the shaft.

9. The apparatus of claim 8 wherein the shaft comprises a first portion and a second portion threadedly engaged with the first portion.

10. The apparatus of claim 8 further comprising friction reducing bearings disposed between the shaft and the first, second, and third wheels, wherein the bearings each comprise at least one radial shoulder extending circumferentially along an outer surface of each bearing, and wherein each radial shoulder of the bearings abuts a corresponding radial shoulder of the first, second, and third wheels.

11. The apparatus of claim 1 wherein the first wheel has a first outer diameter and the second and third wheels each have a second outer diameter that is smaller than the first outer diameter.

12. The apparatus of claim 1 wherein the first, second, and third wheels collectively form a spherical or spheroidal shape.

13. The apparatus of claim 1 wherein the first, second, and third wheels each comprise at least two radial shoulders extending circumferentially along each inner surface.

14. The apparatus of claim 1 wherein the first wheel comprises a first axial width, wherein the second wheel comprises a second axial width, wherein the third wheel comprises a third axial width, and wherein the first axial width is greater than each of the second and third axial widths.

15. A method, comprising:

selecting three wheels which collectively form an elliptical profile having a collective cross-sectional diameter that is smaller than a cross-sectional diameter of at least a portion of a wellbore extending into a subterranean formation;

coupling the three wheels to an apparatus such that the three wheels are independently rotatable about a first axis and collectively rotatable about a second axis perpendicular to the first axis;

coupling the apparatus to an end of a downhole tool;

conveying the downhole tool and apparatus within the wellbore, including rolling the three wheels along a sidewall of the wellbore; and removing the downhole tool and apparatus from the wellbore.

16. The method of claim 15 wherein selecting the three wheels comprises selecting the three wheels such that the collective cross-sectional diameter of the elliptical profile varies from the cross-sectional diameter of the at least portion of the wellbore by less than about ten percent.

17. The method of claim 15 wherein selecting the three wheels further comprises selecting the three wheels such that the collective cross-sectional diameter of the elliptical profile of the selected three wheels is less than about ten percent smaller than the cross-sectional diameter of the at least a portion of the wellbore.

18. The method of claim 15 wherein selecting the three wheels further comprises selecting a central wheel having an axial width that is greater than axial widths of outer wheels each located on opposing side of the central wheel.

19. The method of claim 15 further comprising, before coupling the three wheels to the apparatus, inserting a friction bearing into axial bores of the three wheels such that an outer radial shoulder of each friction bearing abuts an inner radial shoulder of a corresponding one of the three wheels.

20. An apparatus, comprising:

a housing operable for connection with a downhole tool; and three wheels carried with the housing, wherein the wheels are independently rotatable about a first axis and collectively rotatable about a second axis perpendicular to the first axis, wherein the three wheels comprise a central wheel and two outer wheels disposed on opposite sides of the central wheel, wherein the central wheel comprises a first width along the first axis, wherein the outer wheels comprise a second width along the first axis, and wherein the first width is greater than the second width.

21. The apparatus of claim 20 wherein the central wheel has a first outermost diameter, wherein the outer wheels each have a second outermost diameter, and wherein the first outermost diameter is larger than the second outermost diameter.

22. The apparatus of claim 20 further comprising:

a plurality of arms extending between the housing and the three wheels; and at least one shaft extending through each of the plurality of arms, a first one of the wheels, and at least a portion of each of a second one and a third one of the wheels, wherein the first axis is a longitudinal axis of the at least one shaft.

23. The apparatus of claim 22 wherein the three wheels each comprise an inner surface defining a corresponding axial bore, and wherein the three wheels each comprise at least one radial shoulder extending circumferentially along each inner surface.

24. The apparatus of claim 23 wherein the three wheels each comprise at least two radial shoulders extending circumferentially along each inner surface.

25. The apparatus of claim 23 further comprising friction reducing bearings disposed between the shaft and the three wheels, wherein the bearings each comprise at least one radial shoulder extending circumferentially along an outer surface of each bearing, and wherein each radial shoulder of the bearings abuts a corresponding radial shoulder of the three wheels.

26. The apparatus of claim 20 wherein the first width is about two times greater than each of the second and third widths.

* * * * *